US012628886B2

(12) United States Patent
Brucker et al.

(10) Patent No.: US 12,628,886 B2
(45) Date of Patent: May 19, 2026

(54) STOWABLE UPPER-TORSO SUPPORT GARMENT

(71) Applicant: NIKE, Inc., Beaverton, OR (US)

(72) Inventors: Greta R. Brucker, Portland, OR (US); Elizabeth H. Koopman, Hillsboro, OR (US); Lisa L. Mechanic, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/918,814

(22) Filed: Oct. 17, 2024

(65) Prior Publication Data

US 2025/0127242 A1 Apr. 24, 2025

Related U.S. Application Data

(60) Provisional application No. 63/545,112, filed on Oct. 20, 2023.

(51) Int. Cl.
*A41C 3/00* (2006.01)

(52) U.S. Cl.
CPC ..... *A41C 3/0035* (2013.01)

(58) Field of Classification Search
CPC ..... A41C 3/0035
USPC ..... 450/89
See application file for complete search history.

(56) References Cited

U.S. PATENT DOCUMENTS 6,626,733 B1 9/2003 Knutson
7,585,200 B1 * 9/2009 McLaren ..... A41C 3/0035 450/1
11,785,993 B1 10/2023 Zuniga
2008/0032600 A1 * 2/2008 Updyke ..... A41C 3/0057 450/89
2011/0065359 A1 * 3/2011 Kenny ..... A41C 3/12 450/39
2012/0034842 A1 * 2/2012 Roberts ..... A41C 3/0035 450/89
2012/0329366 A1 * 12/2012 Kenny ..... A41C 3/12 450/89
2015/0257457 A1 * 9/2015 Kenny ..... A41C 3/12 450/89
2016/0058079 A1 * 3/2016 Sexton ..... A41C 3/0035 2/455
2025/0127242 A1 * 4/2025 Brucker ..... A41C 3/0035
2025/0176645 A1 * 6/2025 Migliozzi ..... A41C 3/0057

FOREIGN PATENT DOCUMENTS

WO 2018/213522 A1 11/2018

OTHER PUBLICATIONS

International Search Report and Written Opinion received for PCT Patent Application No. PCT/US2024/051962, mailed on Jan. 8, 2025, 11 pages.

* cited by examiner

*Primary Examiner* — Gloria M Hale
(74) *Attorney, Agent, or Firm* — Shook, Hardy & Bacon L.L.P.

(57) ABSTRACT

A self-stowing support garment for an upper-torso of a wearer. The garment features an integrally formed pocket on its back, which can be inverted or folded inside-out. The remaining portion of the garment is then pushed into the inverted pocket space. Some examples include a tunnel at the pocket opening with a drawcord for tightening. When stowed, the garment assumes the form of a small pouch, providing greater convenience and modesty compared to carrying the support garment openly.

19 Claims, 12 Drawing Sheets

UPPER-TORSO SUPPORT GARMENT 100
STOWED CONFIGURATION 104

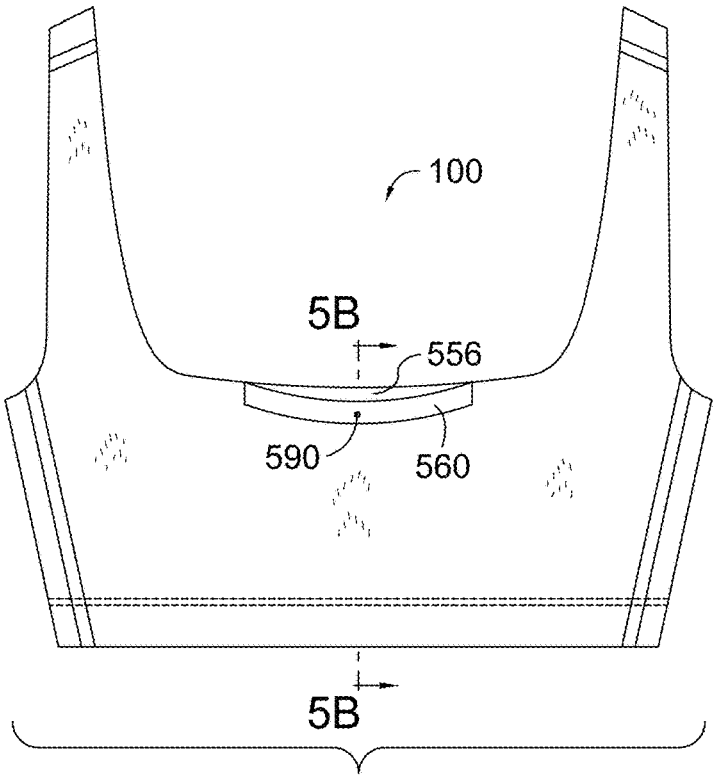
FIG. 5A
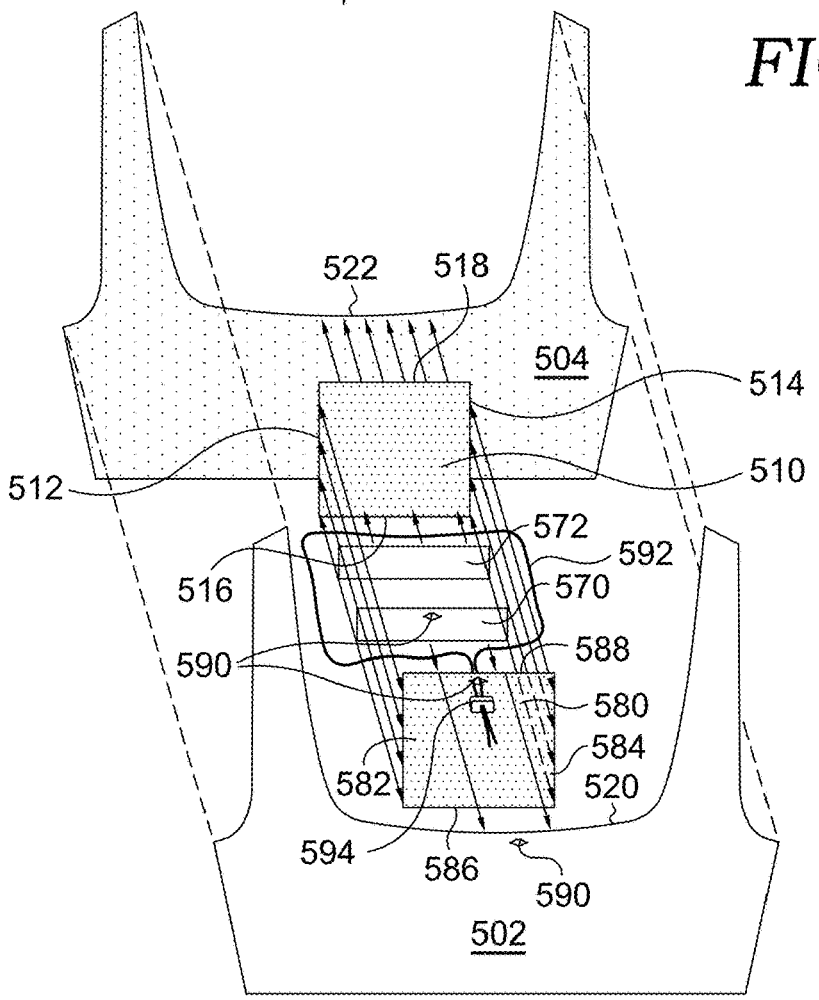

STOWABLE UPPER-TORSO SUPPORT GARMENT

CROSS-REFERENCE TO RELATED APPLICATIONS

This patent application claims the benefit of U.S. Prov. App. No. 63/545,112, entitled "Stowable Upper-Torso Support Garment," filed Oct. 20, 2023. The aforementioned application is incorporated herein by reference in its entirety.

BACKGROUND

Upper-torso support garments (e.g., bras) are sometimes used by wearers "on the go," as they move from one context or environment to the next. For example, a wearer might go from work, to the gym, and then back to work or to a social outing. In some instances, the wearer might want to change into an upper-torso support garment at one location and/or change out of the upper-torso support garment before leaving a location. Typically, an upper-torso support garment must be transported with a bag or other enclosure that is separate from the upper-torso support garment.

BRIEF DESCRIPTION OF THE DRAWINGS

The following drawings are provided to illustrate various examples of the disclosure and are not intended to limit the scope of the invention. The components in the Figures are not necessarily drawn to scale.

FIG. 5A depicts an exploded view of another example upper-torso support garment, in accordance with aspects hereof;

DETAILED DESCRIPTION

Figure 1:
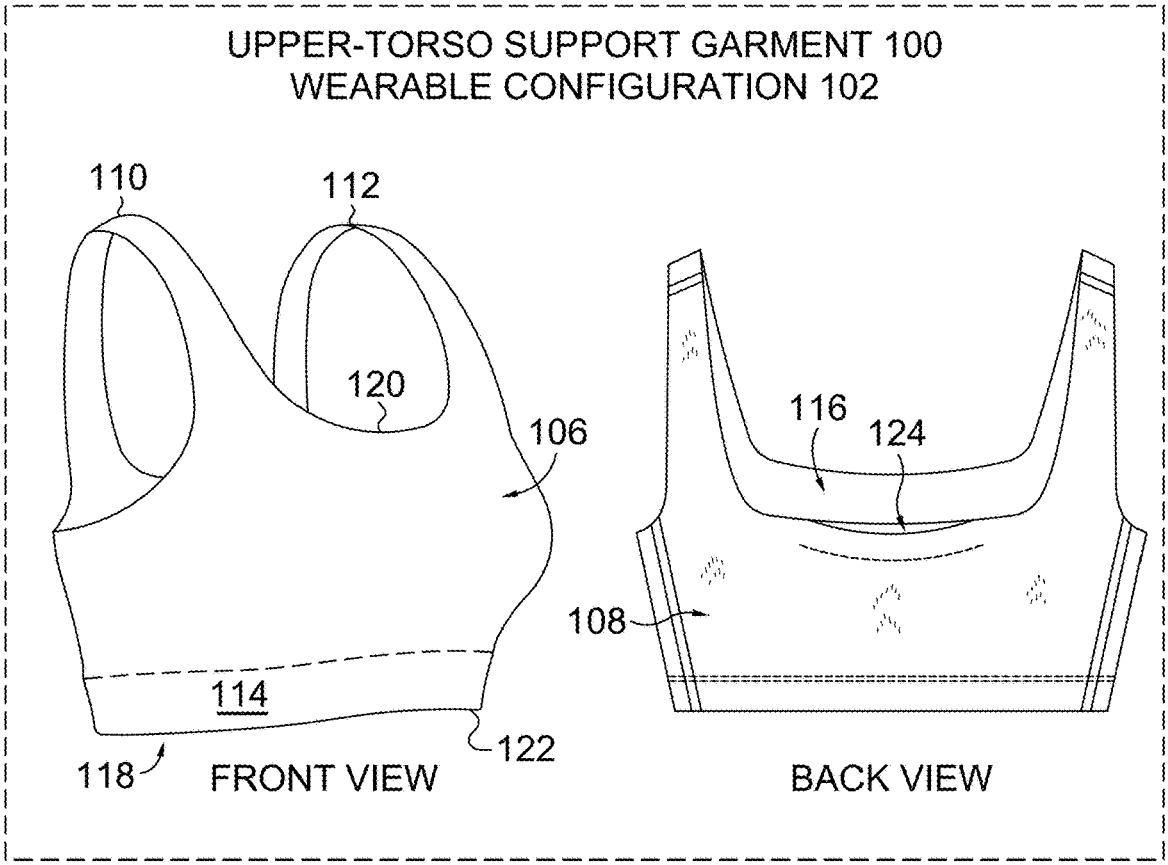
FIG. 1 depicts an example upper-torso support garment in a wearable and a stowable configuration, in accordance with aspects hereof.
Figure 1:
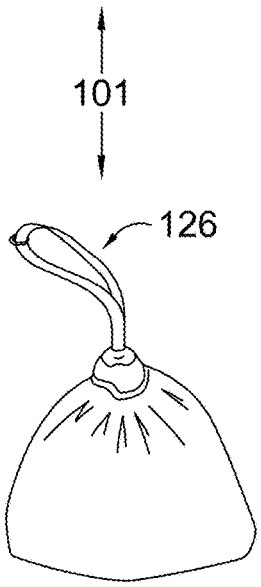

The present disclosure relates to an upper-torso support garment (e.g., bra) designed to provide convenience and discreet portability and storage for users. The upper-torso support garment includes a pocket structure integrated into the design, which allows the garment to be stowed and carried in a compact manner when not in use. The pocket structure is strategically positioned on the garment to ensure minimal interference during various activities, thereby reducing wearer distractions and potential discomfort. The garment offers convenient storage and portability features while ensuring optimal comfort and functionality for the wearer. The garment incorporates various technical features that contribute to its compactness, ease of use, and enhanced performance.

The field of athletic wear and support garments has seen significant advancements to cater to the needs of active individuals. In particular, upper-torso support garments (e.g., sports bras) play a crucial role in providing comfort, support, and stability for women engaging in physical activities. However, the practicality and portability of traditional sports bras have often posed challenges for individuals who are frequently on the move. Conventional support garments lack a convenient storage solution, requiring users to carry them openly or find separate containers or bags.

The present invention addresses these challenges by introducing a stowable support garment that offers a practical and discreet storage solution that is highly portable. The invention is described primarily as an upper-torso support garment, such as a sports bra, while maintaining a disclosure with broader applicability to different types of support garments. In examples, the upper-torso support garment includes a pocket structure on the back of the garment, allowing for efficient stowing and portability.

In at least some examples, the integrally formed pocket is capable of being inverted or folded inside-out, creating an inverted pocket space. By pushing the remaining portion of the garment into this inverted pocket space, the support garment can be stowed and transformed into a compact, pouch-like form. This stowed configuration offers several advantages, including improved portability, easy storage, and increased privacy and modesty compared to carrying the support garment openly. Examples of the present disclosure include various solutions to address the shortcomings of existing support garments in terms of portability, storage, and discretion. By integrating a stowable feature through a pocket structure, the support garment offers enhanced convenience, versatility, and privacy for active individuals, athletes, and those frequently on the move.

In at least some examples, the garment has a torso portion is designed to cover the wearer's upper torso. The torso portion includes a front portion and a back portion, which is coupled to the front portion via shoulder straps. The back portion is formed from an outer material layer and an inner material layer that are secured together and create an interstitial space.

In at least some examples, the back portion can also include a pocket formed, in part, by at least one pocket panel that is secured to the outer or inner layer. A pocket space of the pocket is accessible between the top edges of the outer and inner layers. In addition, an opening to the pocket can be located between the top edges of the back portion, which can facilitate easy insertion and removal of the garment (e.g., when the garment is being stowed in, or removed from, the pocket). This feature enables quick access to the stored garment, allowing the wearer to effortlessly transition between wearing and stowing the garment as needed.

The pocket can include several features. For example, it can consist of an open end and a closed end, with a first side edge and a second side edge (e.g., opposite the first side edge) extending between them. The edges can be formed by at least one pocket panel extending from the open end to the closed end (e.g., top edges to bottom edge). The at least one pocket panel helps to at least partially enclose a void (e.g., pocket space), providing the necessary space for stowing the garment.

In examples, one or more of the dimensions of the pocket are configured to optimize portability and ease of use. For instance, the length of one or more ends of the pocket (e.g., the closed end and/or the open end) or the width of the pocket from side-to-side can be based on, or sized in relation to, other portions of the upper-torso support garment. This relationship between a size or dimension associated with the pocket and a size or dimension associated with the upper-torso support garment, can increase the likelihood that the garment can securely fit in the pocket, while allowing for efficient grasping and handling. Similarly, the respective lengths of the first edge and the second edge (e.g. a height of the pocket) can be configured to accommodate the shape and size of the garment in its stowed configuration.

In some examples, the pocket is constructed to facilitate easy grasping when the support garment is stowed within it. In the case of an upper-torso support garment, the pocket structure can include a drawcord extending through a tunnel formed at or adjacent to the open end, allowing the resulting stowed structure to be easily held in the palm of the wearer's hand. The drawcord can then be tensioned to secure the garment and positioned around the wearer's fingers or palm, enabling convenient carrying even during athletic activities. The pocket structure can be sized to accommodate the stowed garment, making it possible to place it within a bag or pack without occupying significant space.

The garment can be advantageously formed from lightweight or ultra-lightweight materials. For example, in some examples, the garment can be constructed of knit, woven, or nonwoven textiles having yarns that compositionally include various materials (e.g., polyester, recycled polyester, elastane, nylon, cotton, and the like). Material construction and composition not only contributes to the overall comfort and fit of the bra but also facilitates compression into a small volume. The pocket itself can be constructed from a woven, nonwoven, or knit material, providing durability and dimensional stability. For example, mesh (e.g., warp knit mesh) could be used to enhance breathability (e.g., both when worn and when a soiled garment is stowed), while a material such as elastane could be incorporated into the mesh to make stowing easier (e.g., so the pocket can stretch open to receive the garment and then recover to a smaller stowage size). The use of such materials helps maintain the compactness of the pocket structure when the garment is stowed and enhances its ability to retain the stowed garment securely. In some examples, at least a portion of the pocket can be constructed from a textile that hides moisture (e.g., perspiration), such that when a bra is stowed in the pocket, perspiration absorbed by the textile layers of the bra might not show through to the exterior face of the pocket. The combination or sub-combination of these technical features and advantages ensures that the garment provides a practical and versatile solution for users. It enables convenient storage, portability, and ease of use, making it ideal for individuals on the go, travelers, athletes, and anyone seeking a compact undergarment without compromising comfort and functionality.

The term "support garment" when used herein refers to an upper-body garment or upper-torso garment primarily configured to provide support to a wearer's breasts. As such, the support garment can be in the form of a bra, including a nursing bra and/or athletic bra, a tank top, an athletic top, a swimsuit top, and the like. When the garment is in the form of a support garment or bra, the term "breast-covering portion" means the portion of the support garment configured to cover a wearer's breast. In example aspects and with respect to the first and second breast-covering portions of the first layer, the breast-covering portions can cover substantially all of the wearer's breasts (e.g., up to about 90% of the surface area of the wearer's breast). As such, the breast-covering portion generally extends from a top part (e.g., near the wearer's clavicle) to a lower part (e.g., the wearer's inframammary fold) of each of the wearer's breasts and from a medial edge (e.g., near the wearer's sternum) to a lateral edge (e.g., near the wearer's axilla) of each of the wearer's breasts. In other example aspects and with respect to the third and fourth breast-covering portions, the breast-covering portions can cover portions of the wearer's breasts. For example, the breast-covering portions can cover areas surrounding the nipple area of the wearer but the nipple area cannot be covered by the breast-covering portions (i.e., the nipple area can be positioned within the openings in the second layer). The term "lower band" when used in relation to, for instance, a support garment or bra refers to the portion of the bra that forms a lower margin of at least a front portion or a back portion of the bra (e.g., an underband portion). The lower band is configured to encircle the torso area of a wearer and can include a separate pattern piece or can include an integral extension of at least the front portion or the back portion of the support garment.

Positional terms used when describing the support garment such as upper, bottom, lower, middle, internal, vertically, and the like are with respect to the support garment being worn as intended with the wearer standing upright. For example, the term "inner" or "internal" means a layer or structure that is positioned closer to a body surface of a wearer as compared to other layers or structures of the support garment. The term "outer" means a layer or structure that is positioned external to other layers or structures of the support garment. In example aspects, an inner layer can be an innermost layer and an outer layer can be an outermost layer of the support garment. Portions of the support garment described as upper are located closer to a wearer's head with respect to portions of the support garment described as lower or bottom which are located closer to a wearer's feet. The term "vertical" means in a direction along an axis that extends from a wearer's head to a wearer's feet.

In various aspects, a support garment disclosed herein is formed from a textile. As used herein, the terms "textile" or "textile component" include, for example, knitted, woven, and nonwoven fabrics or cloth.

The term "secured to," as used herein, is not meant to limit the scope of this disclosure. Rather, the term "secured to" implies that a component can be directly secured to another component, or that a component can be affixed at a location adjacent another component.

Additionally, there are various measurements provided herein. Unless indicated otherwise, all measurements provided herein are taken when the support garment is at standard ambient temperature and pressure (298.15 K and 100 kPa) and is in a resting (non-tensioned) state.

Unless indicated otherwise, the term "about" or "substantially" with respect to a measurement means within ±10% of the indicated value.

FIG. 1 depicts a diagram showing an upper-torso support garment 100 (support garment 100) convertible between a plurality of different configurations, based on an example of this disclosure. For example, FIG. 1 depicts the support garment 100 in a "wearable" configuration 102 and in a "stowed" configuration 104. A "wearable" configuration refers to a configuration in which support garment 100 is not contained within a pocket structure, such that support garment 100 can be donned and doffed by a wearer. A "stowed" configuration refers to a configuration in which support garment 100 is contained within a pocket structure. As indicated by the arrow 101, the support garment 100 is convertible between the wearable configuration and the stowed configuration.

The support garment 100 includes a front portion 106 and a back portion 108, as well as a first shoulder strap 110, a second shoulder strap 112, and a lower band 114. In examples, the first should strap 110 and the second shoulder strap 112 can support the support garment 100 on the wearer's shoulders, and the lower band 114 can at least partially circumscribe a torso of the wearer. In addition, the support garment 100 includes a neck opening 116 and a torso opening 118. The neck opening 116 is defined, formed, and/or circumscribed at least in part by the first shoulder strap 110 and the second shoulder strap 112 and by upper extents or margins (e.g., neck opening edge 120) of the front portion 106 and the back portion 108. The torso opening 118 is defined at least in part by a torso opening edge 122, which can be the lower edge of the lower band 114 and/or the lower edge of the front portion 106 and the back portion 108. FIG. 1 depicts a bra, and in other examples the support garment 100 can include a variety of other types of support garments that include the same or similar elements.

The support garment 100 can be constructed of a variety of different textiles, including knit textiles, woven textiles, nonwoven textiles, mesh textiles, spacer textiles, films, composites, laminates, and any and all combination thereof. For example, the front portion 106 or the back portion 108 can be constructed of one or more pattern pieces, each of which can include one or more different textiles.

Examples of the present disclosure include a construction and features that allow for convenient and discreet portability and storage of the support garment 100, such as when the support garment 100 is in the stowed configuration 104 or when the support garment 100 is being converted between configurations. For example, the support garment 100 includes a pocket 124 constructed into the back portion 108 of the support garment 100, and the support garment 100 can be tucked inside the pocket 124 when converting the support garment 100 from the wearable configuration 104 to the stowed configuration 106.

In examples, features of the pocket 124 allow for minimal to no interference during various activities, which can reduce wearer distractions and potential discomfort. In addition, the pocket 124 can contribute to a discreet and optimally sized storage solution for the support garment 100. In some examples, the pocket 124 can impart an interesting aesthetic to the stowed configuration 106, in which the bag form includes minimal seams.

Figure 2A:
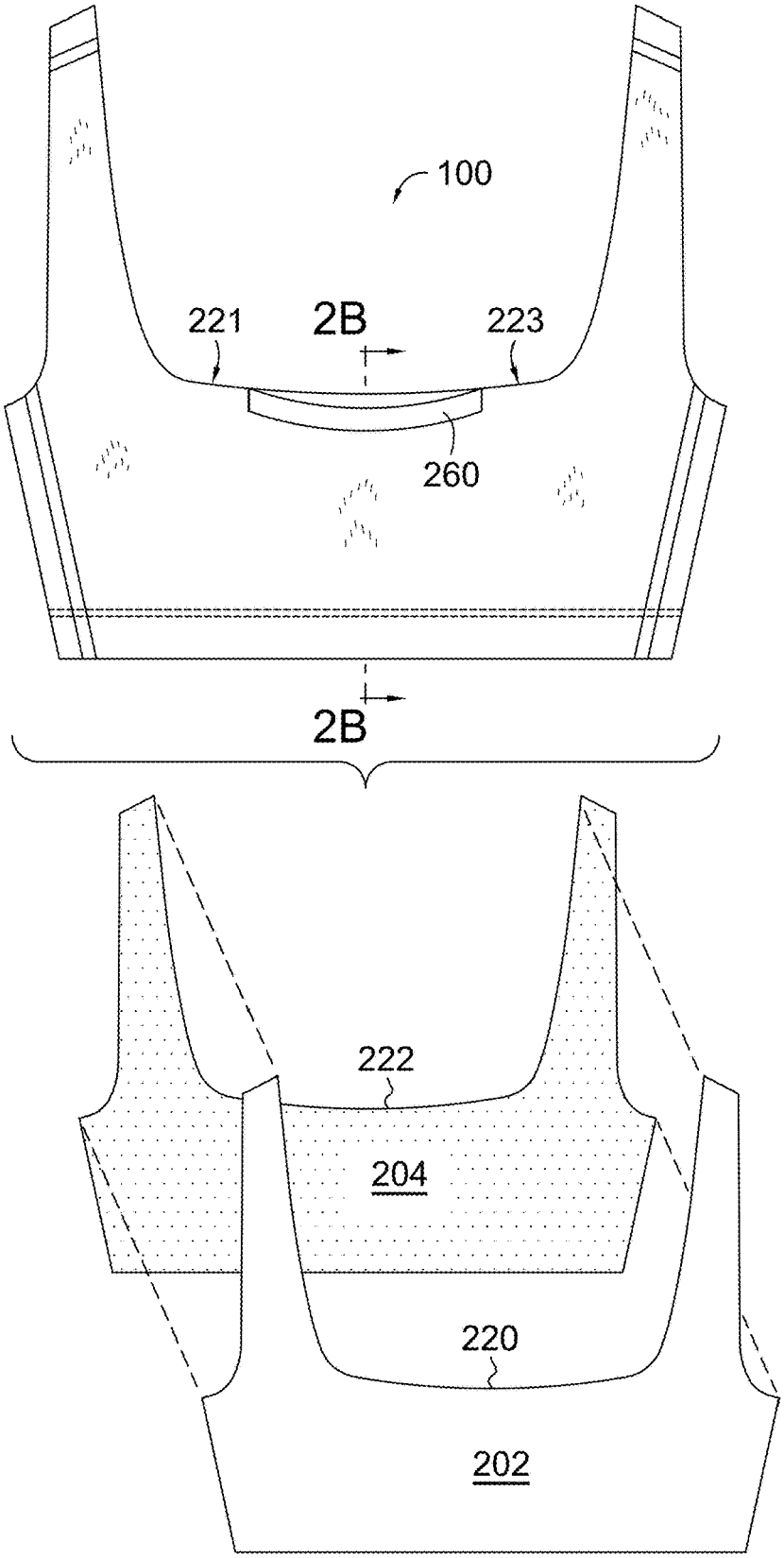
FIG. 2A depicts an exploded view of an example upper-torso support garment, in accordance with aspects hereof.

A pocket for stowing a support garment can include various features. Referring to FIGS. 2A, an exploded view of an example back portion 208 is depicted, and in some instances, the back portion 208 is the same as, or similar to, the back portion 108 in FIG. 1. The back portion 208 includes an outer layer 202 and an inner layer 204. In some examples, one or more other layers can be combined with one or more of the outer layer 202 and the inner layer 204.

In some examples, a tensioning mechanism 260 is included. The tensioning mechanism 260 is generically illustrated in FIG. 2A, and can include other designs and constructions. In general, the tensioning mechanism 260 can include a drawcord (e.g., 126 in FIG. 1) or other flexible elongated member (e.g., elastic, elongated member) that is at least partially contained within a tubular, drawcord sleeve, tunnel, or encasement (e.g., formed via a top edge 220/222 folded over, an additional trim piece, integrally knit, etc.). The tensioning mechanism 260 (e.g., the drawcord of the tensioning mechanism 260) can operate to secure items stowed in the pocket on the back portion 208, such as when the garment and pocket are inverted and the garment is tucked into the pocket. In addition, the tensioning mechanism 260 (e.g., the drawcord of the tensioning mechanism 260) can provide a grab loop, carrying handle, Additional details regarding potential examples that include the tensioning mechanism 260 and its integration in an upper-torso support garment such as support garment 100 are discussed in more detail with regards to FIGS. 5A and 5B.

Figure 2B:
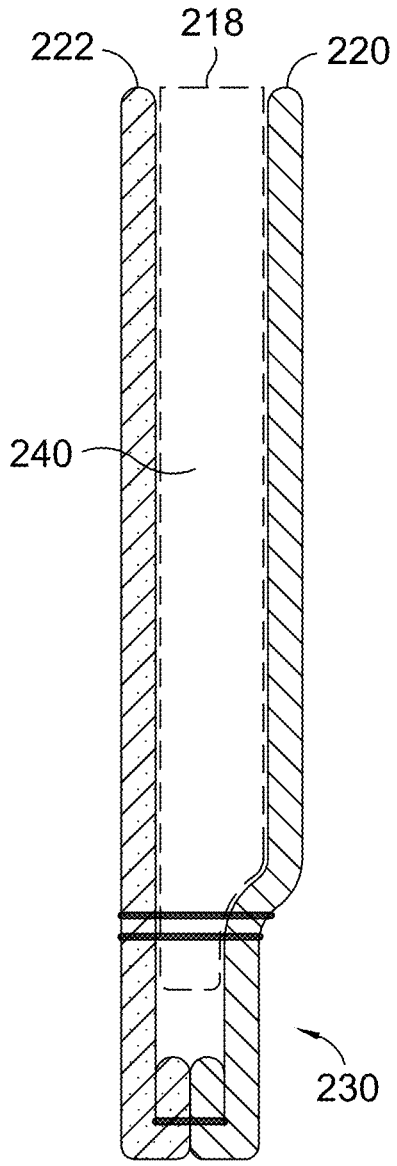
FIG. 2B depicts a cross-sectional view of the example upper-torso support garment of FIG. 2A taken along line 2B-2B of FIG. 2A.

Referring to FIG. 2B as well, in at least some examples, the outer layer 202 is affixed to the inner layer 204 (e.g., along the lower band 230), and an interstitial space 240 is positioned between the outer layer 202 and the inner layer 204. In addition, the outer layer 202 includes a top edge 220, and the inner layer 204 includes a top edge 222. In some areas, portions of the top edges 220 and 222 can be coupled to one another, such as along segments 221 and 223 of the top edges 220 and 222. In addition, in examples of the present disclosure, at least a portion of the top edge 220 of the outer layer 202 is detached from the top edge 222 of the inner layer 204, such that the interstitial space 240 is accessible through an opening or gap between the top edges 220 and 222. The top edges 220 and 222 are generically depicted. In some examples, the top edges 220 and 222 (and any top edges described in this disclosure, such as 322 and 420) can include any combination of edge-finishing structures, including any one or more of a cut edge, a fold down, trim, seam tape, and the like.

In at least some examples of the present disclosure, a pocket that includes one or more pocket panels 218 (e.g., in addition to the outer panel 202 and the inner panel 204) is positioned in the interstitial space 240 and is configured to contain the support garment 100 in a stowed configuration 104. The one or more pocket panels 218 (schematically depicted in dash lines) can include various configurations. In at least some examples, the one or more pocket panels 218 can include at least one pocket panel having a pocket panel top edge that is affixed to the top edge 220 or 222 and is detached from the other of the top edge 220 or 222. In addition, the at least one pocket panel of the one or more pocket panels 218 can include a pocket panel bottom edge that is affixed to, or near, the lower band 230. These and other examples are further disclosed below.

In examples of the present disclosure, at least a portion of a pocket panel (e.g., any of the pocket panels described throughout this disclosure), can include a moisture-management textile that reduces (e.g., significantly hides or eliminates) the visibility of moisture (e.g., perspiration) on a face of the moisture-management textile. In examples, the moisture-management textile can include a hydrophobic layer and a hydrophilic layer. The hydrophilic layer can be positioned on the face of the moisture-management textile oriented towards the other material layers of the garment (e.g., the body textile layers of the garment). The hydrophobic layer can be oriented towards the pocket space, when the garment in a wearable configuration, and oriented outward and away from the stowed garment when the garment is in a stowed configuration.

In at least some examples, the moisture-management textile can include a spacer textile (e.g., knit spacer, woven spacer, etc.) with the hydrophobic layer comprising one side of the spacer textile, the hydrophilic layer on the opposing side of the spacer textile, and tie yarns or connecting yarns extending between (and connecting) the hydrophilic layer and the hydrophobic layer. In some examples, the moisture-management textile can include a tubular-jacquard knit textile having one side that is hydrophobic and an opposing side that is hydrophilic. The tubular-jacquard knit textile can, in some instances, include one or more yarns that pass back and forth between the hydrophilic layer and the hydrophobic layer (e.g., as tuck stitches or otherwise).

In examples, the hydrophobic layer can include one or more yarns that are hydrophobic, and the hydrophilic layer can include one or more yarns that are hydrophilic. As indicated above, these yarns can be combined in various ways to form the textile, such as by knitting, weaving, non-woven techniques (e.g., spun bond, melt blown, mechanically entangled fiber webs, etc.).

In some instances, the hydrophobic yarns can include inherent hydrophobic properties. For example, the hydrophobic yarns can include natural fibers that are naturally hydrophobic or synthetic yarns that are hydrophobic (e.g., based on the composition of the synthetic yarn). In some examples, the hydrophobic yarns can include a hydrophobic finish, such as a DWR finish, and/or can be impregnated with a hydrophobic component. The hydrophobic yarns can be treated prior to be integrated into the first knit layer, can be treated after being integrated into the first knit layer, or any combination thereof.

In some instances, the hydrophilic yarns can include inherent hydrophilic properties. For example, the hydrophilic yarns can include natural fibers that are naturally hydrophilic or synthetic yarns that are hydrophilic. In some examples, the hydrophilic yarns can include a hydrophilic finish, such as a wicking finish, and/or can be impregnated with a hydrophilic component. The hydrophilic yarns can be treated prior to be integrated into the second knit layer, can be treated after being integrated into the second knit layer, or any combination thereof.

In examples, the moisture-management textile (e.g., spacer textile, tubular-jacquard knit textile, composite non-woven, etc.) can include a yarn or fiber that passes back and forth between the first layer and the second layer. In at least some examples, the yarn that passes back and forth can include an elastic yarn (or have elastic properties), such as a bare elastic yarn or a covered elastic yarn. In examples where the textile is a spacer textile, the yarn that passes back and forth between layers can include a tie yarn. In examples, where the textile is a tubular-jacquard knit textile, the yarn that passes back and forth can include a tuck stitches crossing over back and forth, or other type of stitch passing back and forth between the front side and the back side.

A yarn passing back and forth between the layers of the moisture-management textile can operate in various manners to impart functionality and properties to the textile. For example, such yarns help to separate or space apart the first knit layer and the second knit layer which, when combined with the knit construction of the first knit layer and the second knit layer, can create a more open structure promoting breathability and permeability. Separating or spacing apart the first knit layer and the second knit layer through the use of yarns can also reduce the likelihood of contamination of finishes between the layers and helps to isolate a particular finish (e.g., wicking or DWR) to one surface of the moisture-management textile.

In examples, moisture (e.g., perspiration absorbed in the inner layer 204) produced by the wearer is taken up by the second knit layer due to, for example, the hydrophilic properties (e.g., associated with the natural properties, added properties, moisture wicking finish, etc.) associated with the yarns forming the second knit layer. In some examples, the moisture can spread throughout the second knit layer due to capillary action. In addition, where the moisture-management textile includes an open structure (e.g., based at least partially on the second layer being spaced apart from the first layer by a yarn extending therebetween) the moisture can evaporate.

In at least some examples, moisture transfer from the second layer to the first layer is minimized, such as where the yarn extending between the layers is a bare elastic yarn. In addition, any moisture that is transferred to the first knit layer is repelled based on the hydrophobic properties (e.g., DWR treatment) associated with yarns of the first knit layer. As such, when a soiled garment (e.g., bra with absorbed sweat) is stowed in the bag or storage compartment, the moisture does not show through on an outer-facing surface of the pocket panel forming the outer wall of the bag.

Figure 3A:
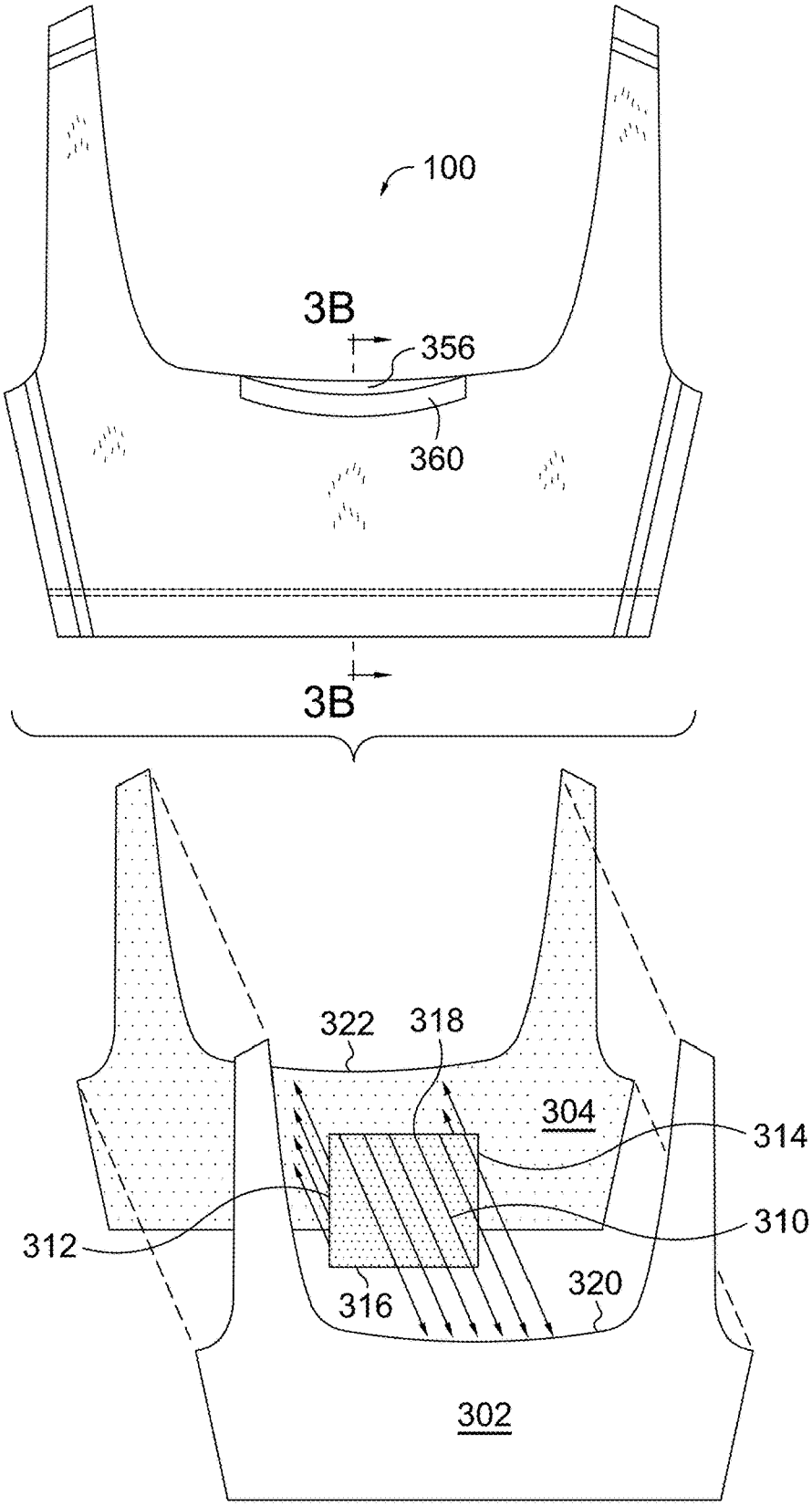
FIG. 3A depicts an exploded view of another example upper-torso support garment, in accordance with aspects hereof.
Figure 3B:
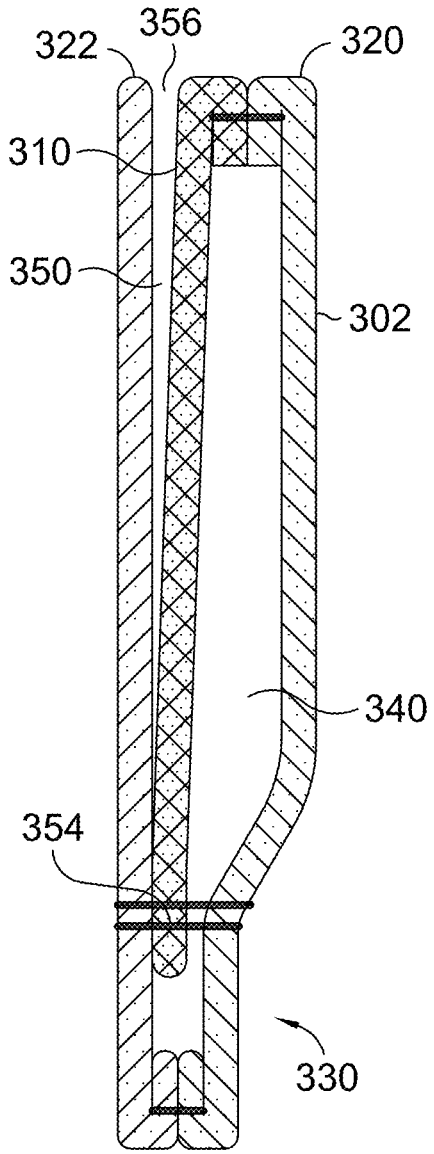
FIG. 3B depicts a cross-sectional view of the example upper-torso support garment of FIG. 3A taken along line 3B-3B of FIG. 3A, in accordance with aspects hereof.

FIGS. 3A and 3B shows an example of how an outer layer 302, an inner layer 304, and a pocket panel 310 can be integrated with each other to form support garment 100 with a structure that provides convenience and portability for users. For example, the integration of said components with each other forms a pocket 350 that is accessible at a pocket opening 356 and extends down to a bottom edge 354 of pocket 350. In order to form pocket 350 to stow support garment 100 within, FIGS. 3A and 3B illustrate an example of support garment 100 with a single pocket panel, pocket panel 310, which can be comprised of a first side edge 312, a second side edge 314, a bottom panel edge 316, and a top panel edge 318. Pocket panel 310 can be formed of the same, similar, or different material as inner layer 304. In FIG. 3A, and in other figures of this disclosure, arrows are used to illustratively depict points of connection (e.g., between the edge 318 and the edge 320).

As discussed previously, the two-layered structure formed by affixing outermost layer 302 with innermost layer 304 creates interstitial space 340, which is located between outer layer 302 and inner layer 304. Interstitial space 340 can be at least partially defined by outermost layer 302, innermost layer 304, and a lower band 330. Pocket panel 310 can be formed by sewing a separate piece of material within the interstitial space of support garment 100. In some examples, the pocket can be integrally knit during the formation of support garment 100. To create an enclosed pocket space, separated from an interstitial space 340, pocket panel 310 can be affixed to either or both of outer layer 302 and inner layer 304 along first side edge 312, second side edge 314, bottom panel edge 316, and top panel edge 318. In some examples, top panel edge 318 can be affixed to outer layer 302 at, or adjacent, pocket opening 356 (e.g., near or along the edge 320) to prevent fraying and to add strength while still allowing access to the pocket. In addition, by coupling the top edge 318 of the pocket panel 310 along the top edge 320 of the outer panel 302, seams (and seaming operations) can be minimized by securing the top edge 318 of the panel 310 in any trim construction along the top edge 320 of the outer layer 302. This can provide a construction with fewer seams (e.g., with a cleaner look and reduced opportunities for seam-related chaffing, de-coupling, etc.) and that is more efficiently manufactured. Pocket panel 310 can be affixed to either outer layer 302 or inner layer 304 such that it lies flat against the body and doesn't disrupt the primary function of support garment 100, which is to provide support and comfort during physical activity while also allowing for easy and convenient stowage.

Lower band 330 can include one or more elastic materials, which can impart stretchability. The lower band 330 can provide support and helps keep the sports bra secure and in place during physical activities. In some examples, lower band 330 can be formed of the same material as outer layer 302, can be an extension of outer layer 302 that is separated from interstitial space 340, or can be formed separately and affixed to support garment 100. As illustrated in FIG. 3B, lower band 330 can at least partially define the enclosed pocket space of pocket 350 where bottom panel edge 316 is affixed to one or more of outer layer 302, inner layer 304, and lower band 330. Bottom panel edge 316 can be affixed at lower band 330 to form bottom edge 354 of pocket 350 (e.g., the lower band 330 can define the bottom end or edge of the enclosed pocket space). That is, the bottom edge 316 of the pocket panel 310 can be affixed to the lower band 330, and seams (and seaming operations) can be minimized by securing the bottom edge 316 with any seams that form the lower band 330 or affix the lower band 330 to the inner and outer layers 302 and 304. This can provide a construction with fewer seams (e.g., with a cleaner look and reduced opportunities for seam-related chaffing, de-coupling, etc.) and that is more efficiently manufactured.

In order to create pocket 350 within interstitial space 340, yet separated from interstitial space 340, first side edge 312 and second side edge 314 of pocket panel 310 can extend from top edge 320 formed by outer layer 302 to bottom edge 354 of pocket 350. In examples shown by FIGS. 3A and 3B, first side edge 312 can extend from top edge 320 to bottom edge 354 and be affixed to inner layer 304 along at least part of first side edge 312, and second side edge 314 can be affixed to inner layer 304 similarly. Such a configuration helps secure the pocket panel to support garment 100, creating left and right sides of the pocket. Additionally, creating pocket 350 in this fashion allows for less material to be used than examples which use more than one pocket panel. In some examples, pocket panel 310 can be configured to have a greater width at bottom panel edge 316 than at top panel edge 318 in order to provide an adequate volume for pocket 350 to retain support garment 100 depending on the quantity of material used to form support garment 100.

Pocket 350 is accessible through pocket opening 356, which extends between top edge 320 and top edge 322. In some examples, top panel edge 318 of pocket panel 310 can be affixed to a different material layer than first side edge 312 and second side edge 314. For example, if first side edge 312 and second side edge 314 are affixed to inner layer 304, top panel edge 318 can be affixed to outer layer 302 at, or adjacent, top edge 320. In some examples, top panel edge 318 can be affixed to a bottom portion of a tensioning mechanism 360. Tensioning mechanism 360 allows pocket opening 356 to be tightened or loosened as needed, adding an extra level of security to maintain support garment 100 in the stowed configuration. Furthermore, a component such as a drawstring can be included as part of the tensioning mechanism, which could also allow for an easier way to carry or transport support garment 100 in the stowed configuration.

Figure 4A:
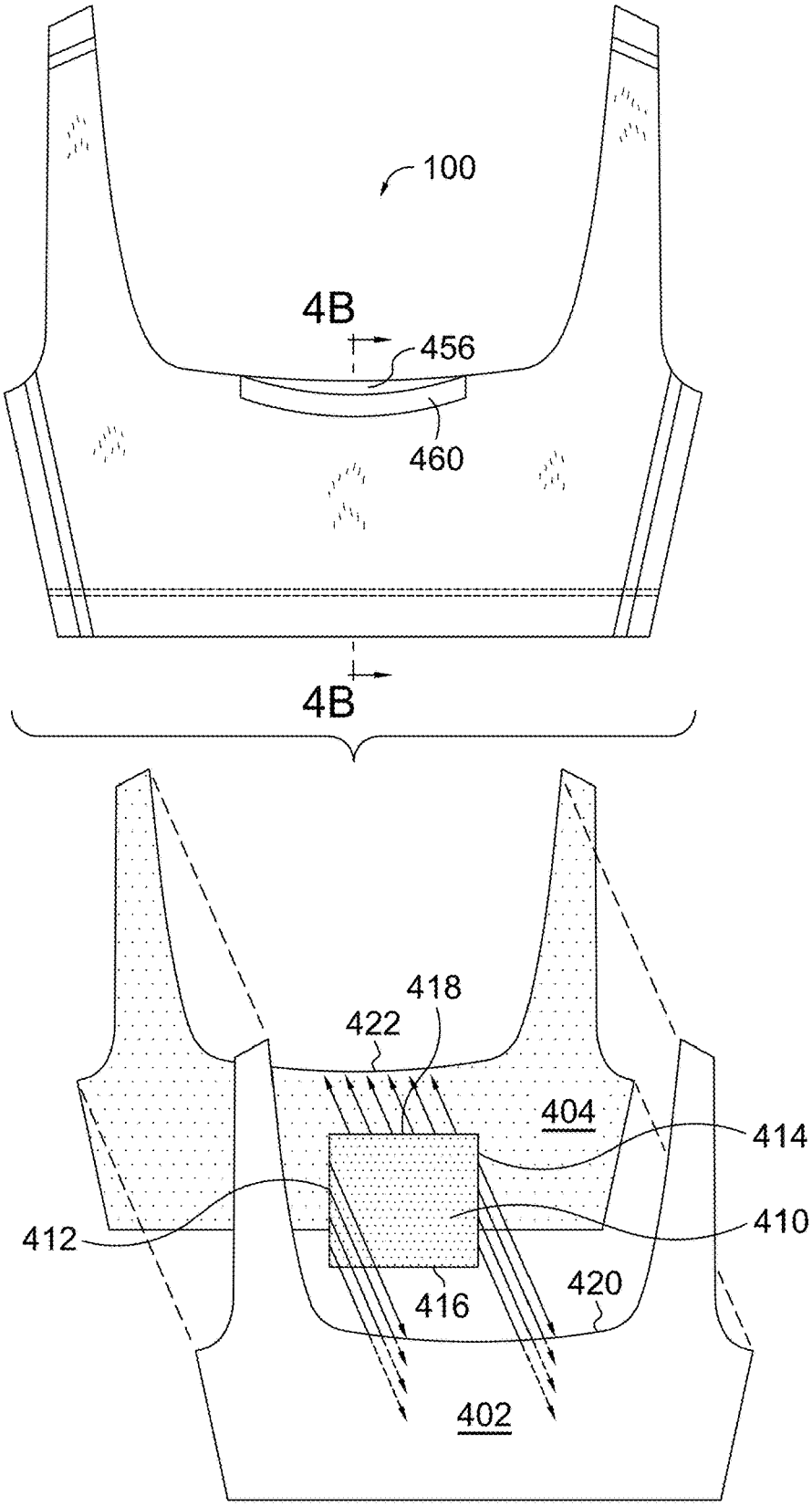
FIG. 4A depicts an exploded view of another example upper-torso support garment, in accordance with aspects hereof.
Figure 4B:
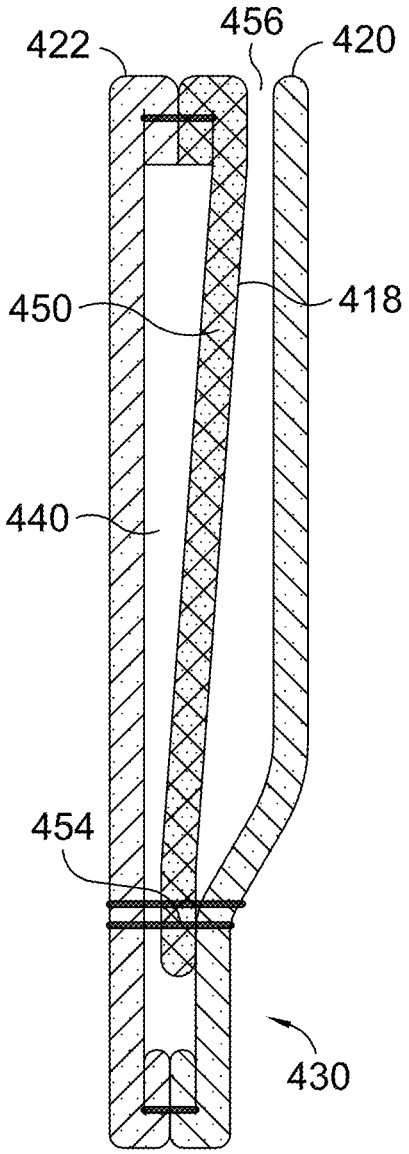
FIG. 4B depicts a cross-sectional view of the example upper-torso support garment of FIG. 4A taken along line 4B-4B of FIG. 4A, in accordance with aspects hereof.

FIGS. 4A and 4B shows another example of how an outer layer 402, an inner layer 404, and a pocket panel 410 can be integrated with each other to form support garment 100 with a structure that provides convenience and portability for users. For example, the integration of said components with each other forms a pocket 450 that is accessible at a pocket opening 456 and extends down to a bottom edge 454 of pocket 450. In order to form pocket 450 to stow support garment 100 within, FIGS. 4A and 4B illustrate another example of support garment 100 with a single pocket panel, pocket panel 410, which can be comprised of a first side edge 412, a second side edge 414, a bottom panel edge 416, and a top panel edge 418. Pocket panel 410 can be strategically located and secured in various configurations depending on the design of support garment 100, as will be discussed further below. Pocket panel 410 can be formed of the same, similar, or different material as inner layer 404. Pocket panel 410 can be formed by sewing a separate piece of material within the interstitial space of support garment 100, or can be integrally knit during the formation of support garment 100. To create an enclosed pocket space, separated from an interstitial space 440, pocket panel 410 can be affixed to either or both of outer layer 402 and inner layer 404 along first side edge 412, second side edge 414, bottom panel edge 416, and top panel edge 418. In some examples, top panel edge 418 can be affixed to inner layer 404 at, or adjacent, pocket opening 456 (e.g., near or along a top edge 420 or a top edge 422) to prevent fraying and to add strength while still allowing access to the pocket. In addition, by coupling the top edge 318 of the pocket panel 310 along the top edge 320 of the outer panel 302, seams (and seaming operations) can be minimized by securing the top edge 318 of the panel 310 in any trim construction along the top edge 320 of the outer layer 302. This can provide a construction with fewer seams (e.g., with a cleaner look and reduced opportunities for seam-related chaffing, de-coupling, etc.) and that is more efficiently manufactured. Pocket panel 410 can be affixed to either outer layer 402 or inner layer 404 such that it lies flat against the body and doesn't disrupt the primary function of support garment 100, which is to provide support and comfort during physical activity while also allowing for easy and convenient stowage.

As discussed previously, the two-layered structure formed by affixing outermost layer 402 with innermost layer 404 creates interstitial space 440, which is located between outer layer 402 and inner layer 404. Interstitial space 440 can be at least partially defined by outermost layer 402, innermost layer 404, and a lower band 430. Lower band 430 can include one or more elastic materials, which can impart stretchability. The lower band 430 can provide support and helps keep the sports bra secure and in place during physical activities. In some examples, lower band 430 can be formed of the same material as outer layer 402, can be an extension of outer layer 402 that is separated from interstitial space 440, or can be formed separately and affixed to support garment 100. As illustrated in FIG. 4B, lower band 430 can at least partially define the enclosed pocket space of pocket 450 where bottom panel edge 416 is affixed to one or more of outer layer 402, inner layer 404, and lower band 430. Bottom panel edge 416 can be affixed at lower band 430 to form bottom edge 454 of pocket 450 (e.g., the lower band 430 can define a bottom end or edge of the enclosed pocket space). That is, the bottom edge 316 of the pocket panel 310 can be affixed to the lower band 330, and seams (and seaming operations) can be minimized by securing the bottom edge 316 with any seams that form the lower band 330 or affix the lower band 330 to the inner and outer layers 302 and 304. This can provide a construction with fewer seams (e.g., with a cleaner look and reduced opportunities for seam-related chaffing, de-coupling, etc.) and that is more efficiently manufactured.

In order to create pocket 450 within interstitial space 440, yet separated from interstitial space 440, first side edge 412 and second side edge 414 of pocket panel 410 can extend from top edge 422 formed by inner layer 404 to bottom edge 454 of pocket 450. In examples shown by FIGS. 4A and 4B, first side edge 412 can extend from top edge 422 to bottom edge 454 and be affixed to outer layer 402 along at least part of first side edge 412, and second side edge 414 can be affixed to outer layer 402 similarly. Such configurations help secure the pocket panel to support garment 100, creating left and right sides of the pocket. Additionally, creating pocket 450 in this fashion allows for less material to be used than examples which use more than one pocket panel. In some examples, pocket panel 410 can be configured to have a greater width at bottom panel edge 416 than at top panel edge 418 in order to provide an adequate volume for pocket 450 to retain support garment 100 depending on the quantity of material used to form support garment 100.

Pocket 450 is accessible through pocket opening 456, which extends between top edge 420 and top edge 422. In some examples, top panel edge 418 of pocket panel 410 can be affixed to a different material layer than first side edge 412 and second side edge 414. For example, if first side edge 412 and second side edge 414 are affixed to outer layer 402, top panel edge 418 can be affixed to inner layer 404 at, or adjacent, top edge 422. In some examples, top panel edge 418 can be affixed to a bottom portion of a tensioning mechanism 460. Tensioning mechanism 460 allows pocket opening 456 to be tightened or loosened as needed, adding an extra level of security to maintain support garment 100 in the stowed configuration. Furthermore, a component such as a drawstring can be included as part of the tensioning mechanism, which could also allow for an easier way to carry or transport support garment 100 in the stowed configuration.

Figure 5B:
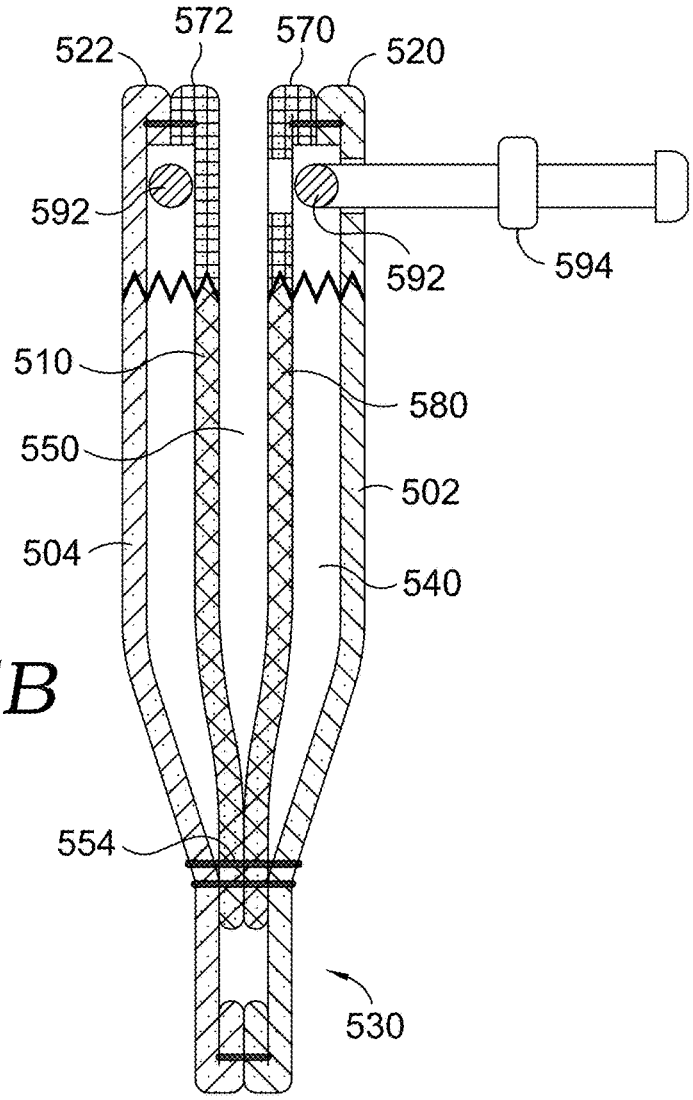
FIG. 5B depicts a cross-sectional view of the example upper-torso support garment of FIG. 5A taken along line 5B-5B of FIG. 5A, in accordance with aspects hereof.
Figure 5C:
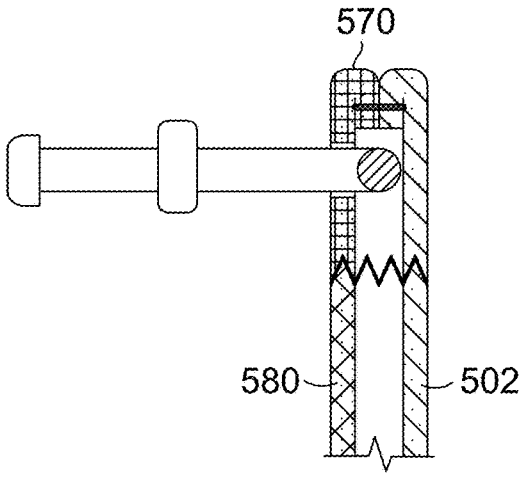
FIG. 5C depicts a version that is similar to FIG. 5B, except with a drawcord extending through an aperture in a tunnel trim, in accordance with aspects hereof.

FIGS. 5A and 5B show an example of how an outer layer 502, an inner layer 504, and one or more pocket panels (e.g., pocket panels 510,580) can be integrated with each other to form support garment 100 with a structure that provides convenience and portability for users. For example, the integration of said components with each other forms a pocket 550 that is accessible at a pocket opening 556 and extends down to a bottom edge 554 of pocket 550. In order to form pocket 550 to stow support garment 100 within, pocket panel 510 can be comprised of a first side edge 512, a second side edge 514, a bottom panel edge 516, and a top panel edge 518. Similarly, pocket panel 580 can be comprised of a first side edge 582, a second side edge 584, a bottom panel edge 586, and a top panel edge 588. Pocket panels 510,580 can be strategically located and secured in various configurations depending on the design of support garment 100, as will be discussed further below. In at least some examples, the pocket panels 510 and 580 can comprise a single panel that is folded over (e.g., near a midline) to form two panels that are connected at the fold.

As discussed previously, the two-layered structure formed by affixing outermost layer 502 with innermost layer 504 creates an interstitial space, interstitial space 540 located between outer layer 502 and inner layer 504. Interstitial space 540 can be at least partially defined by outer layer 502, inner layer 504, and a lower band 530. Lower band 530 can be an elasticated band that provides support and helps keep the sports bra secure and in place during physical activities. In some examples, lower band 530 can be formed of the same material as outer layer 502, can be an extension of outer layer 502 that is separated from interstitial space 540, or can be formed separately and affixed to support garment 100. As illustrated, lower band 530 can also act at least partially as a base of pocket 550, where bottom panel edges 516,586 can be affixed to one or more of outer layer 502, inner layer 504, and lower band 530, depending on the desires of the operator. Bottom panel edges 516,586 can be affixed at this location to form bottom edge 554 of pocket structure 550.

In order to create pocket space 552 within interstitial space 540, yet separated from interstitial space 540, first side edges 512,582 and second side edges 514,584 of pocket panels 510,580 can be secured to one or more components as discussed below to help create left and right sides of pocket 550. As shown in FIG. 5A (e.g., via the arrows), first side edge 512 can be secured to first side edge 582, and second side edge 514 can be secured to second side edge 584. Also shown, top panel edge 518 can be secured to (or near) top edge 522, and top panel edge 588 can be secured to (or near) top edge 520 (e.g., integrated into the trim, seams, or other edge finishing constructions associated with the top edges 522 and 520). In addition, bottom panel edges 516 and 586 can be secured to the lower band (e.g., integrated into the trim, seams, or other edge finishing constructions associated with the lower band).

In some examples, pocket panels 510,580 can be configured to have a greater width at bottom panel edges 516,586 than at top panel edges 518,588 in order to provide an adequate volume for pocket 550 to retain support garment 100 depending on the quantity of material used to form support garment 100. Although the description in FIGS. 1-7 generally refers to "edges" being affixed, it should be noted that a location adjacent the edges are also suitable for affixation. For example, as illustrated in FIG. 5A, bottom panel edges 516,586 extend within lower band 530 and bottom edge 554 of pocket structure 550 is formed by affixing first pocket panel 510 and second pocket panel 580 adjacent bottom panel edges 516,586.

In some examples, first side edge 582 and second side edge 584 of pocket panel 580 can be affixed to one or more of outer layer 502 and the corresponding first side edge 512 and second side edge 514 of pocket panel 510. For example, first side edge 582 can extend from first top edge 520 to bottom edge 554 of pocket 550 in examples where top panel edge 588 is affixed to first top edge 520. However, for a majority of a length of first side edge 582 (e.g., a portion of first side edge 582 extending between first top edge 520 and bottom edge 554), first side edge 582 can be affixed to first side edge 512 of pocket panel 510. In some examples, first side edge 582 is only affixed to first side edge 512 along the majority of its length. In other examples, first side edge 582 can also be affixed to outer layer 502 along the majority of its length. Second side edge 584 can have a similar configuration as first side edge 582 with respect to outer layer 502 and second side edge 514 of pocket panel 510.

In examples, bottom panel edge 586 can be affixed to one or more of outer layer 502, inner layer 504, pocket panel 510, and a lower band 530 at bottom edge 554. Similarly, bottom panel edge 516 can be affixed to one or more of outer layer 502, inner layer 504, pocket panel 580, and lower band 530 at bottom edge 554 (e.g., the seaming construction forming the bottom edge 554). For example, when bottom panel edge 586 is affixed to bottom panel edge 516, they can at least partially define bottom edge 554 of pocket 550. Continuing with the example, when the affixed bottom panel edge 586 and bottom panel edge 516 are also affixed to lower band 530, pocket 550 can have its position within interstitial space 540 secured to help ensure minimal interference during activity. As indicated in other portions of this disclosure, by securing the bottom panel edge 586 to the lower band 530, seams (and seaming operations) can be minimized, which can provide a construction with fewer seams (e.g., with a cleaner look and reduced opportunities for seam-related chaffing, de-coupling, etc.) and that is more efficiently manufactured. The ability for pocket structure 550 to reduce wearer distractions and potential discomfort by such securement is even more pronounced in an example in which first side edges 512,582 and second side edges 514,584 are not affixed to outer layer 502 and inner layer 504, respectively.

In some examples, such as when first side edges 512,582 and second side edges 514,584 are also affixed to outer layer 502 and inner layer 504, respectively, in addition to each other, bottom panel edge 516 and bottom panel edge 586 can be affixed to one another only along the majority of their length. In such an example, bottom edge 554 may not be located at lower band 530 but, instead, at a location between first top edge 520 or second top edge 522 and lower band 530. Such an example (e.g., a pocket whose bottom edge could be located between a top and bottom of a back portion) can be desired when implementing a design with a relatively wider pocket 550, which contains an adequate amount of volume without extending to lower band 530. As the pocket 550 widens, a resulting shape of the support garment 100 in the stowable configuration can become tubular, which may provide a more convenient option for a wearer to carry around depending on needs of a particular user.

Pocket 550 is accessible through pocket opening 556, which extends between first top edge 520 and second top edge 522. In some examples, a tensioning mechanism 560 is included. Tensioning mechanism 560 may comprise a drawcord tunnel (or sleeve or encasement) that is configured to hold a drawcord or other elongated member, which can allow pocket opening 556 to be tightened or loosened as needed, adding an extra level of security to maintain support garment 100 in the stowed configuration. Furthermore, a component such as the drawcord can also allow for an easier way to carry or transport support garment 100 in the stowed configuration.

The drawcord tunnel of tensioning mechanism 560 can include various constructions. In some examples, the drawcord tunnel can include one or more of pocket strips or trim pieces 570, 572 that can be coupled with the pocket panels and the inner and outer layers to form a sleeve or encasement for the drawcord. Cross-sectional views of the drawcord encasement formed by the trim pieces 570 and 572 can be seen in FIG. 5B (and alternatively in FIG. 5C). In examples, one or more apertures (e.g., 590) can be positioned along the encasement and can permit the drawcord (and any hardware coupled to the drawcord, such as a slidable cord lock) to extend through the textile wall and from inside the encasement to outside the encasement. In some examples, the aperture can be positioned in the outer layer 502. In some examples, such as in FIG. 5C, the aperture can be positioned in the trim piece 570 that is affixed to the outer layer 502. Also, in some examples, such as in FIG. 5B, apertures can be positioned in both the outer layer 502 and the trim piece 570. An aperture in the outer layer 502 can allow a wearer to position the drawcord and hardware further away from the wearer. An aperture in the trim piece 570 can permit the wearer to stow the drawcord in the pocket space and out of view when the garment is in the wearable configuration. Apertures in both the outer layer and the trim piece can allow a wearer to select which position they want to arrange the drawcord, which can add versatility to the garment. Apertures can likewise be positioned in the trim piece 572, in the inner layer 504, or both the trim piece 572 and the inner layer 504.

In some examples, the aperture 590 can be positioned in both an outer panel and an inner panel (e.g., both of pocket panels 510,580 as shown in FIG. 5B), which can position the drawcord, as well as any trim hardware affixed to the drawcord (e.g., toggle), on the outside of the garment in the wearable configuration, which can reduce the likelihood of the drawcord contributing to rubbing, chaffing, or other discomfort. When support garment 100 is inverted into the stowed configuration, the trim hardware can be passed through aperture 590 in order to be located outside of an inverted pocket space and used to help maintain tension and secure support garment 100 within the inverted pocket space. In some examples, the aperture 590 can be positioned only in the inner panel (e.g., FIG. 5C) to help maintain a positioning of the tensioning mechanism 560 in the wearable configuration while still allowing the tensioning mechanism 560 to be located outside of the inverted pocket space in the stowed configuration.

Referring to FIG. 5B, in at least some examples, a bottom portion (e.g., edge) of the trim 570 can be affixed (e.g., at a seam) to a top portion (e.g., edge 588) of the pocket panel 580. In some examples, the trim 570 is affixed to the pocket panel 580 via a seam that also extends through to the outer layer 502, which effectively forms a bottom portion of the encasement. In addition, a top portion (e.g., edge) of the trim 570 can be affixed to the top edge 520 of the outer layer, which closes the top of the encasement. As such, the tubular encasement for the drawcord 592 is formed by the combination of the trim piece 570 and the outer layer 502, together with the seam that connects the trim 570 to the pocket panel 580. The trim 572 can be similarly affixed to the pocket panel 510 and the inner layer 504.

In some examples, the trim pieces 570 and 572 can include a different textile as compared to the pocket panels 510 and 580 (e.g., the materials can have different material properties). For example, the pocket panels 510 and 580 can include a first textile (e.g., mesh) that is lighter weight, more breathable, and with a lower modulus of elasticity, whereas the trim pieces 570 and 572 can include a second textile that is heavier weight with a higher modulus of elasticity. In examples, the material properties of the trim pieces can be configured to provide stability and strength to the top rim of the pocket, such as when the garment is in a stowage configuration. In some examples, the material properties of the pocket panel can be configured to stretch to accommodate a stored garment, and also recover to provide a compactness.

In at least some examples, the side edges of the tunnel strips are not directly connected to one another, such that a gap or opening is positioned at the side junctions between the trim pieces 570 and 572. Such a configuration of pocket strips 570,572 allow for proper cinching of the tensioning mechanism 560 through the drawcord tunnel without inhibition (e.g., allows the drawcord to slide through when tensioning without the material of pocket strips 570,572 bunching up at their side edges.

In some examples, the trim piece can be omitted, and instead, the top edges 518 and 588 of the pocket panels 510 and 580 can connect to the top edges 522 and 520 of the inner layer 504 and the outer layer 502, respectively. In that case, the drawcord tunnel can still be constructed via a similar stitchline (or other connection) between the pocket panel and the respective body layer and below the top edges.

In some examples (not shown in FIGS. 5B and 5C), the trim 570 and 572 can overlap with the respective pocket panel more (e.g., partially or completely), such as where the top edges of the pocket panels 580 and 510 extend up, and connect to or near, the top edges of the outer layer 502 and inner layer 504, respectively. For example, a bottom edge of tunnel strip 570 can be affixed to pocket panel 580 between top panel edge 588 and bottom panel edge 586 of pocket panel 580.

In examples, unless otherwise described, tunnel strip 572 can have a somewhat similar configuration as tunnel strip 570 relative to pocket panel 510. In some examples, a top edge of tunnel strip 572 can be affixed to second top edge 522 of inner layer 504 and/or top panel edge 518 of pocket panel 510.

In some examples (not depicted), top panel edge 588 can be affixed to one or more of outer layer 502 and tunnel strip 570. For example, when top panel edge 588 is affixed to the top edge of tunnel strip 570, top panel edge 588 can also be affixed to first top edge 520 of outer layer 502. Similarly, top panel edge 518 can be affixed to one or more of inner layer 504 and tunnel strip 572. For example, when top panel edge 518 is affixed to the top edge of tunnel strip 572, top panel edge 518 can also be affixed to second top edge 522 of inner layer 504.

As explained above, in some examples, the tensioning mechanism 560 can include an aperture 590 that extends through one or more of tunnel strip 570, pocket panel 580, and/or outer layer 502. Aperture 590 can be aligned through the aforementioned components. When tensioning mechanism 560 includes a drawcord 592 and a cordlock 594, they may be change their position within support garment 100 by passing through aperture 590. For example, in the wearable configuration, cordlock 594 may be positioned external outer layer 502 so that cordlock 594 does not directly contact the user. In the stowable configuration, cordlock 594 may be pushed through aperture 594 and positioned adjacent tunnel strip 570. In this way, tensioning mechanism 560 can provide comfort in the wearable configuration and security in the stowable configuration. Drawcord 592 can be secured to cordlock 594 and extend through the tunnel formed by tunnel strips 570,572. Drawcord 592 can be positioned between tunnel strips 570,572 and pocket panels 510,580.

Figure 5D:
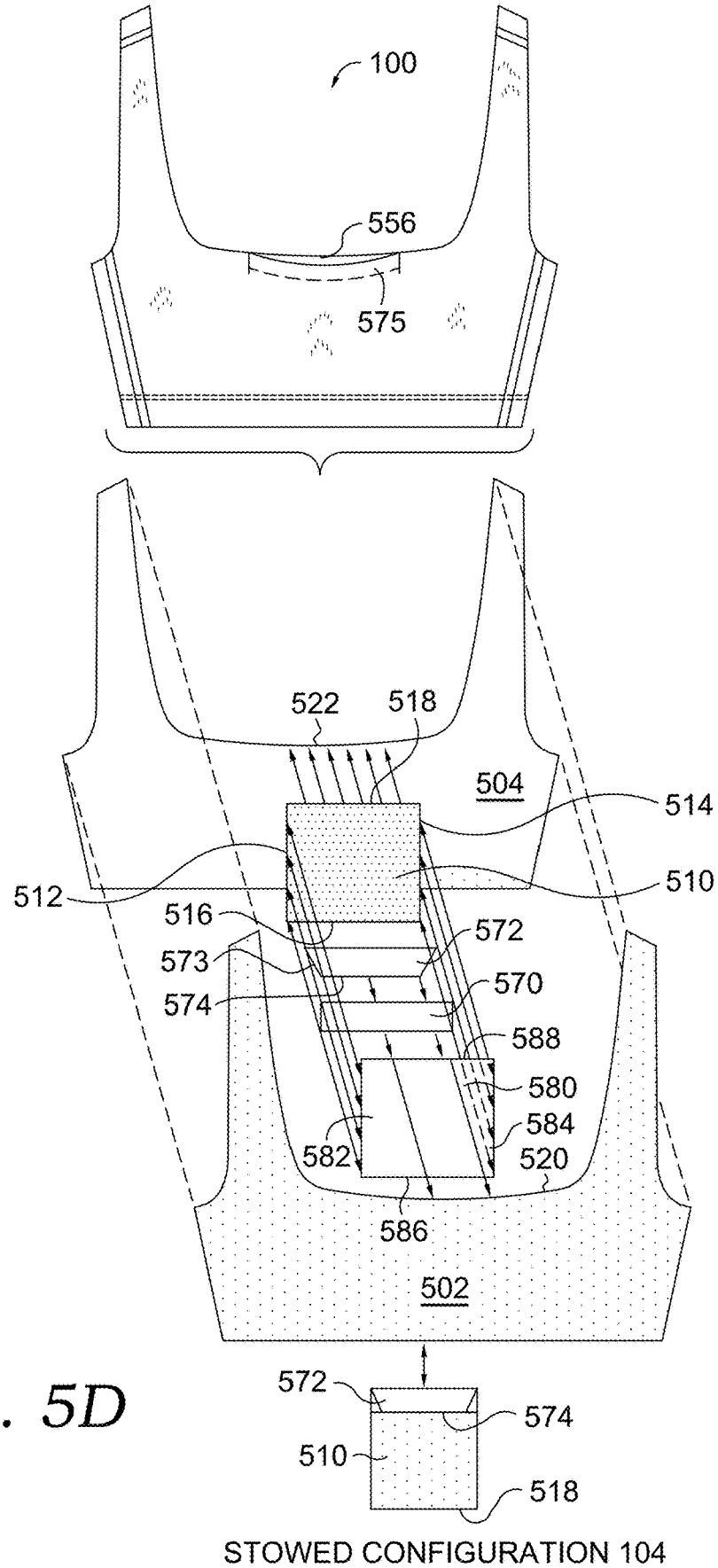
FIG. 5D depicts an exploded view of another example upper-torso support garment that is similar to FIG. 5A, except with a flap closure, in accordance with aspects hereof.

The embodiment illustrated in FIG. 5D may be the same or similar to the previously described embodiment of FIG. 5A, except for the incorporation of a flap closure mechanism 575 instead of the tensioning mechanism 560, as described herein. Specifically, components related to tensioning mechanism 560 in FIG. 5A (e.g., the aperture 590, the drawcord 592, and/or the cordlock 594) have been replaced with flap closure mechanism 575, as discussed further in regards to FIG. 5D. All other aspects, unless explicitly modified, may remain consistent with the structure described in FIG. 5A.

The flap closure mechanism 575 may comprise the strip 572 having a top edge, a first side edge extending from the top edge, a second side edge extending from the top edge, and a bottom edge extending between the first side edge and the second side edge. The first side edge, the second side edge, and the top edge may each be secured to the pocket panel 580 while the bottom edge is unsecured. The unsecured edge (e.g., at least partially forming a flap of the flap closure mechanism 575) may be manipulated when the support garment 100 is in the stowed configuration 104 to overlap the pocket opening 556 to help retain the support garment 100 in the stowed configuration 104. Although shown as either a rectilinear or trapezoidal flap, the flap closure mechanism 575 may have any shape.

The incorporation of the flap closure mechanism 575 into the support garment 100 may enhance the comfort of the wearer, particularly when other items are carried or worn external to the support garment 100. For example, backpacks or other items or garment warn over the support garment 100 may press against the support garment 100 and items integrated therein (e.g., the cord lock, etc.) which could cause discomfort or irritation to the wearer, whereas the present aspect with the flap closure mechanism 575 may not cause discomfort or irritation to the wearer in such circumstances. The flap closure mechanism 575 may also help the support garment 100, when stowed, to lay flat and be retained in the pocket, reducing bulk and helping ensure the stowed garment does not interfere with other items in a bag. In this way, the flap closure mechanism 575 also helps allow for a more streamlined, low-profile shape.

In this embodiment, the structure of the support garment 100 described in relation to FIG. 5A is modified to incorporate the flap closure mechanism 575. Specifically, instead of the top edge of strip 572 attaching to pocket panel 510, it may now be attached to the top edge of strip 570 and/or the pocket panel 580. The bottom edge of the strip 572, however, may remain unattached (e.g., separated) from other components, thereby forming a flap that can be folded over the pocket opening 556 when the support garment 100 is in the stowed configuration 104. For example, the flap closure mechanism 575 comprising the flap can be folded over the pocket opening 556 to close it and help ensure that the support garment 100 remains contained and compact in the stowed configuration 104.

In some aspects, the flap closure mechanism 575 may comprise a tension-based closure where the flap is allowed to fold snugly over the pocket opening 556 and remain secure through the tension generated by the material itself or integrated elastics. This method may help maintain a smooth, flat surface while also providing ease of use. In such aspects, the side edges of the strip 572 may be tapered, with the top edge having a greater length than the bottom edge of the strip 572. This tapering may assist in creating a natural tension-based closure when the flap is folded over, helping to secure the pocket tightly without the need for additional fasteners. In some aspects, the flap closure mechanism 575 may comprise Velcro strips (which offer a quick, secure, and easily adjustable closure that users can operate with minimal effort) or snap-fit buttons (which may employ small snaps or buttons to secure the flap in place, adding a reliable, tactile method of closure while maintaining a sleek appearance) along the flap of the strip 572 and the corresponding pocket panel 510.

Figure 6:
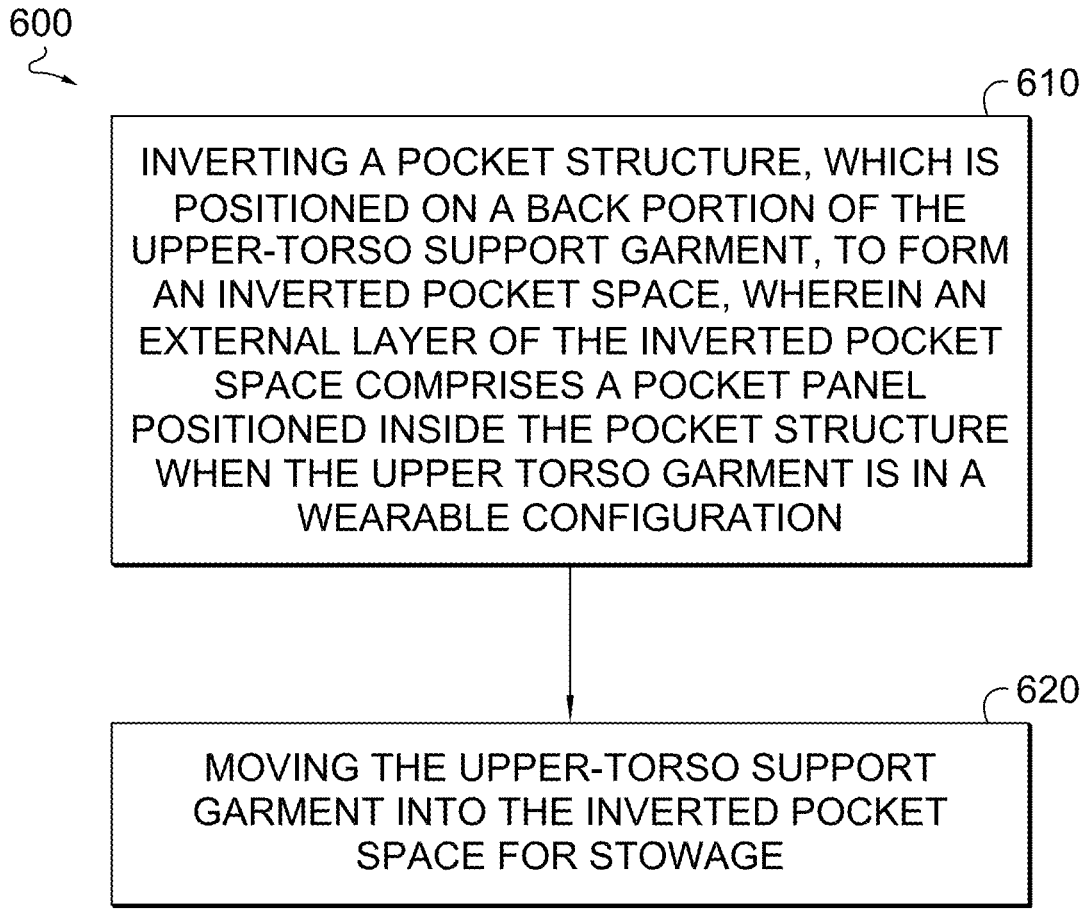
FIG. 6 depicts a flow diagram of an example method of stowing an upper-torso support garment, in accordance with aspects hereof.

With reference to FIG. 6, a method 600, described herein, can be implemented using any or all of the components and component interactions previously described in FIGS. 1-5B. As such, the method is discussed briefly for brevity, though it will be understood that the previous discussion and details described therein can be applicable to aspects of the methods of FIG. 6.

A flow diagram is illustrated showing the method 600 for stowing a support garment within a pocket space provided within the support garment. For example, the support garment referenced with respect to method 600 can be any aspects of support garment 100 discussed previously.

At block 610, a pocket structure, which is positioned on a back portion of the upper-torso support garment, is inverted to form an inverted pocket space, wherein an external layer of the inverted pocket space comprises a pocket panel positioned inside the pocket structure when the upper-torso garment is in a wearable configuration. At block 620, the upper-torso support garment is moved into the inverted pocket space for stowage. In some examples, the pocket structure is inverted by separating the first top edge from the second top edge and pushing or pulling the at least one pocket panel between an opening formed between the first top edge and the second top edge. In some examples, the support garment is stowed within the inverted pocket space such that the at least one pocket panel forms at least part of an external layer in a stowed configuration. In some examples, an incorporated tensioning mechanism is engaged to secure the support garment within the inverted pocket space. In some examples, the tensioning mechanism can include a drawcord located in a knitted tunnel adjacent the opening of the inverted pocket space to allow for easy carrying.

Figure 7:
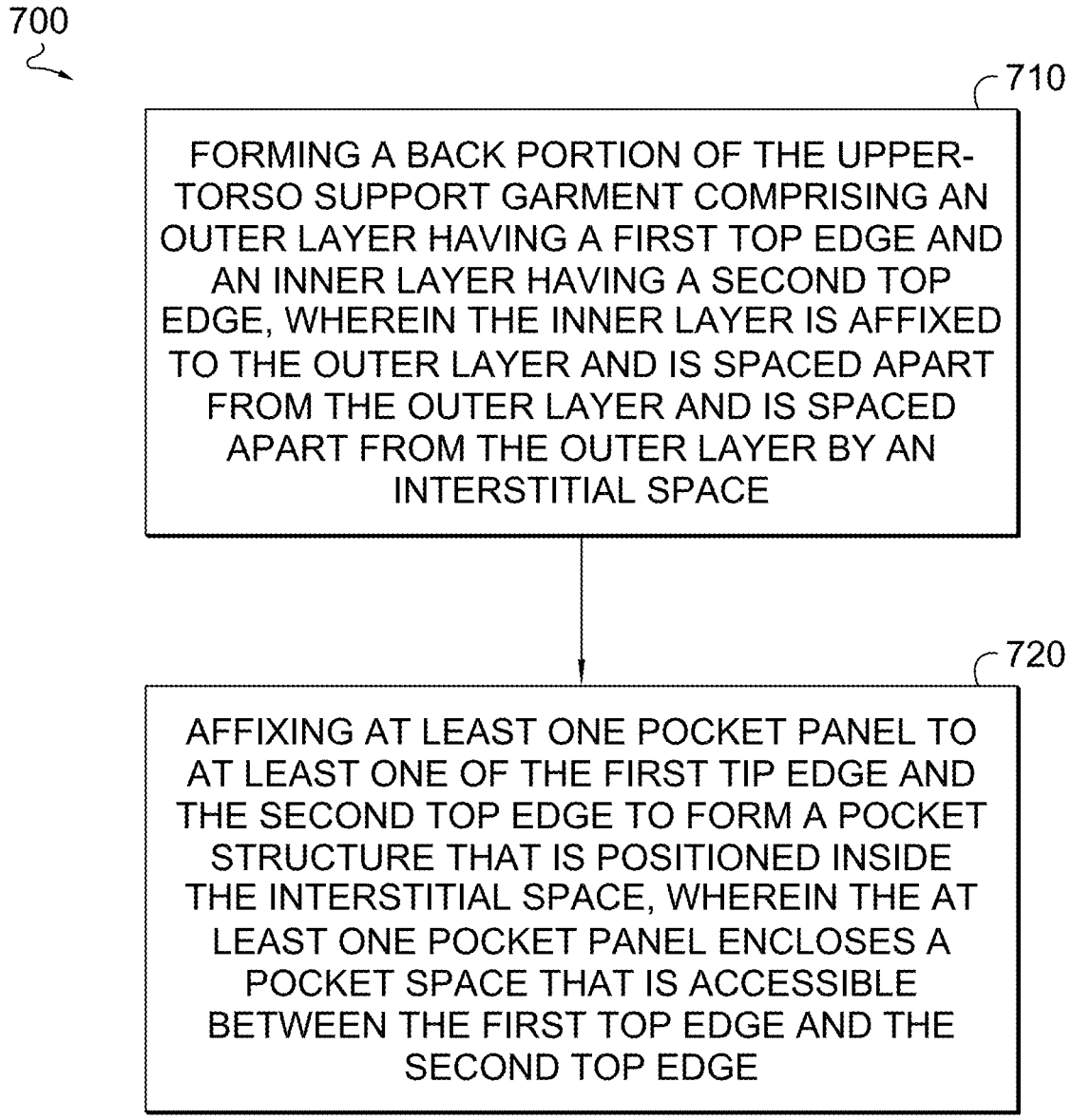
FIG. 7 depicts a flow diagram of an example method of manufacturing an upper-torso support garment, in accordance with aspects hereof.

With reference to FIG. 7, a method 700, described herein, can be implemented using any or all of the components and component interactions previously described in FIGS. 1-6. As such, the method is discussed briefly for brevity, though it will be understood that the previous discussion and details described therein can be applicable to aspects of the methods of FIG. 7.

A flow diagram is illustrated showing the method 700 for manufacturing an upper-torso support garment. For example, the support garment referenced with respect to method 700 can be any aspects of support garment 100 discussed previously.

At block 710, a back portion of the upper-torso support garment is formed comprising an outer layer having a first top edge and an inner layer having a second top edge, wherein the inner layer is affixed to the outer layer and is spaced apart from the outer layer by an interstitial space. At block 720, at least one pocket panel is affixed to at least one of the first top edge and the second top edge to form a pocket structure that is positioned inside the interstitial space, wherein the at least one pocket panel encloses a pocket space that is accessible between the first top edge and the second top edge. For example, as explained previously, the top edge(s) of the pocket panel(s) can be affixed with seaming or other trim construction along the top edge(s) of the inner and/or outer layers. In at least some examples, as explained previously, the bottom edge(s) of the pocket panel(s) can be affixed with seaming or other trim construction along the lower band or underband. In some examples, the back portioned is formed by at least partially affixing the outer layer and the inner layer along a perimeter edge and a lower band to form the interstitial space. In some examples, the pocket structure has a bottom edge at least partially defined by the lower band. In some examples, an additional step is performed comprising affixing one or more pocket strips adjacent the first top edge and the second top edge, wherein the one or more pocket strips form a tunnel. In some examples, an additional step is performed comprising incorporating a tensioning element at least partially within the tunnel formed by the one or more pocket strips.

The following clauses represent aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. An upper-torso support garment comprising a front portion configured to cover a chest region of a wearer; and a back portion that is coupled via shoulder straps to the front portion and comprising an outer layer having a first top edge; an inner layer that is affixed to the outer layer, that is spaced apart from the outer layer by an interstitial space, and that comprises a second top edge; and a pocket structure that is positioned inside the interstitial space and that comprises at least one pocket panel affixed to at least one of the first top edge and the second top edge, wherein the at least one pocket panel at least partially encloses a pocket space and the pocket space is accessible between the first top edge and the second top edge.

Clause 2. The support garment of clause 1 further comprising a lower band that at least partially defines a bottom edge of the pocket structure.

Clause 3. The support garment of clause 2, wherein the at least one pocket panel is affixed to the lower band at the bottom edge.

Clause 4. The support garment of any of clauses 2-3, wherein the at least one pocket panel is affixed to the outer layer at the bottom edge.

Clause 5. The support garment of any of clauses 2-4, wherein the inner layer is affixed to the lower band at the bottom edge.

Clause 6. The support garment of any of clauses 2-5, wherein the at least one pocket panel is affixed to the inner layer at the bottom edge.

Clause 7. The support garment of any of the preceding clauses, wherein the at least one pocket panel comprises a first side edge extending from at least one of the first top edge and the second top edge to the bottom edge, and a second edge extending from the same top edge as the first side edge to the bottom edge, the first edge and the second edge at least partially defining the pocket space.

Clause 8. The support garment of clause 7, wherein the at least one pocket panel is affixed to at least one of the outer layer and the inner layer along the first side edge and the second side edge.

Clause 9. The support garment of any of the preceding clauses, wherein the back portion further comprises a tunnel at least partially formed by the outermost layer of material and located adjacent the first top edge and the second top edge.

Clause 10. The support garment of any of the preceding clauses, wherein the support garment includes a first state and a second state, wherein the first state comprises the support garment in a wearable configuration with the at least one pocket panel positioned in the interstitial space, and wherein the second state comprises a stowage configuration in which the pocket space is inverted and comprises an inverted pocket space and the at least one pocket panel is positioned external to the inverted pocket space.

Clause 11. An upper-torso support garment comprising a front portion configured to cover a chest region of a wearer; and a back portion that is coupled via shoulder straps to the front portion and comprising an outer-facing surface at least partially formed by an outermost layer of material and an inner-facing surface at least partially formed by an innermost layer of material, the outer-facing surface and the inner-facing surface at least partially affixed to each other along a perimeter edge and a lower band to form an interstitial space therebetween; and a pocket structure that at least partially encloses a pocket space and that is at least partially formed by a first pocket panel and a second pocket panel, the pocket structure located at least partially within the interstitial space, the pocket structure having a pocket opening defined by at least a first top edge at least partially formed by the outer layer and a second top edge at least partially formed by the inner layer, the pocket space being accessible between the first top edge and the second top edge, and the pocket structure having a bottom edge at least partially defined by the lower band.

Clause 12. The support garment of clause 11, wherein the first pocket panel is affixed to the lower band at the bottom edge.

Clause 13. The support garment of clause 12, wherein the first pocket panel is affixed to the outer layer at the first top edge.

Clause 14. The support garment of any of clauses 11-13, wherein the second pocket panel is affixed to the lower band at the bottom edge.

Clause 15. The support garment of any of clauses 11-14, wherein the second pocket panel is affixed to the inner layer at the second top edge.

Clause 16. The support garment of any of clauses 11-15, wherein the first pocket panel is affixed to the second pocket panel along a first side edge and a second side edge of the first pocket panel, wherein the first side edge and the second side edge extend between the first top edge and the second top edge, respectively, and wherein the first side edge and the second side edge at least partially define the pocket space.

Clause 17. The support garment of clause 16, wherein the first pocket panel and the second pocket panel are affixed only to each other along their respective first side edges and the second side edges.

Clause 18. The support garment of any of clauses 11-17, wherein a knitted tunnel at least partially formed by the first layer of material and located adjacent the first top edge and the second top edge, wherein the tunnel is configured to receive a tensioning element.

Clause 19. The support garment of clause 18, wherein an aperture is formed through a pocket strip that at least partially forms the tunnel.

Clause 20. The support garment of clause 19, wherein the tensioning element comprises an elastic drawcord and a cord lock, and wherein the cord lock is configured to pass through the aperture such that it can be located on a first side of the tunnel or a second side of the tunnel.

Clause 21. A method of stowing an upper-torso support garment comprising inverting a pocket structure, which is positioned on a back portion of the upper-torso support garment, to form an inverted pocket space, wherein an external layer of the inverted pocket space comprises a pocket panel positioned inside the pocket structure when the upper-torso garment is in a wearable configuration; and moving the upper-torso support garment into the inverted pocket space for stowage.

Clause 22. The method of clause 21, wherein, in the stowed configuration, an inner layer of the upper-torso support garment comprises at least part of the external layer.

Clause 23. A method of manufacturing an upper-torso support garment comprising forming a back portion of the upper-torso support garment comprising an outer layer having a first top edge and an inner layer having a second top edge, wherein the inner layer is affixed to the outer layer and is spaced apart from the outer layer by an interstitial space; and affixing at least one pocket panel to at least one of the first top edge and the second top edge to form a pocket structure that is positioned inside the interstitial space, wherein the at least one pocket panel encloses a pocket space that is accessible between the first top edge and the second top edge.

Clause 24. The method of clause 23, wherein the back portion is formed by at least partially affixing the outer layer and the inner layer along a perimeter edge and a lower band to form the interstitial space.

Clause 25. The method of clause 24, wherein the pocket structure has a bottom edge at least partially defined by the lower band.

Clause 26. The method of any of clauses 23-25 further comprising affixing one or more pocket strips adjacent the first top edge and the second top edge, wherein the one or more pocket strips form a tunnel.

Clause 27. The method of clause 27 further comprising incorporating a tensioning element at least partially within the tunnel formed by the one or more pocket strips.

Clause 28. The support garment of any of clauses 2-5, wherein the pocket structure of the support garment comprises a flap closure mechanism.

Clause 29. The support garment of clause 28, wherein the flap closure mechanism comprises a panel secured along a top edge, a first side edge, and a second side edge to the pocket panel.

Clause 30. The support garment of clause 29, wherein the panel is rectangular.

Clause 31. The support garment of any of clauses 11-15, wherein the pocket structure of the support garment comprises a flap closure mechanism.

While various examples have been described, the description is intended to be illustrative, rather than limiting, and it will be apparent to those of ordinary skill in the art that many more examples and applications are possible within the scope of the present disclosure. Accordingly, the disclosure is not to be restricted except in light of the attached claims and their equivalents. Also, various modifications and changes can be made within the scope of the attached claims.

What is claimed is:

1. An upper-torso support garment comprising:

a front portion configured to cover a chest region of a wearer;

a back portion that is coupled via shoulder straps to the front portion and that comprises:

an outer layer having a first top edge;

an inner layer that is affixed to the outer layer, that is spaced apart from the outer layer by an interstitial space, and that comprises a second top edge;

a pocket structure that is positioned inside the interstitial space and that comprises at least one pocket panel affixed to at least one of the first top edge and the second top edge, wherein the at least one pocket panel at least partially encloses a pocket space and the pocket space is accessible between the first top edge and the second top edge; and a lower band that at least partially defines a bottom edge of the pocket structure.

2. The support garment of claim 1, wherein the at least one pocket panel is affixed to the lower band at the bottom edge.

3. The support garment of claim 2, wherein the at least one pocket panel is affixed to the outer layer at the bottom edge.

4. The support garment of claim 2, wherein the inner layer is affixed to the lower band at the bottom edge.

5. The support garment of claim 1, wherein the at least one pocket panel is affixed to the inner layer at the bottom edge.

6. The support garment of claim 1, wherein the at least one pocket panel comprises a first side edge extending from at least one of the first top edge and the second top edge to the bottom edge, and a second edge extending from the same top edge as the first side edge to the bottom edge, the first edge and the second edge at least partially defining the pocket space.

7. The support garment of claim 6, wherein the at least one pocket panel is affixed to at least one of the outer layer and the inner layer along the first side edge and the second side edge.

8. The support garment of claim 1, wherein the back portion further comprises a tunnel at least partially formed by the outermost layer of material and located adjacent the first top edge and the second top edge.

9. An upper-torso support garment comprising:

a front portion configured to cover a chest region of a wearer;

a back portion that is coupled via shoulder straps to the front portion and that comprises:

an outer-facing surface at least partially formed by an outermost layer of material and an inner-facing surface at least partially formed by an innermost layer of material, the outer-facing surface and the inner-facing surface at least partially affixed to each other along a perimeter edge and a lower band to form an interstitial space therebetween; and a pocket structure that at least partially encloses a pocket space and that is at least partially formed by a first pocket panel and a second pocket panel, the pocket structure located at least partially within the interstitial space, the pocket structure having a pocket opening defined by at least a first top edge at least partially formed by the outer layer and a second top edge at least partially formed by the inner layer, the pocket space being accessible between the first top edge and the second top edge, and the pocket structure having a bottom edge at least partially defined by the lower band.

10. The support garment of claim 9, wherein the first pocket panel is affixed to the lower band at the bottom edge.

11. The support garment of claim 10, wherein the first pocket panel is affixed to the outer layer at the first top edge.

12. The support garment of claim 11, wherein the second pocket panel is affixed to the lower band at the bottom edge.

13. The support garment of claim 12, wherein the second pocket panel is affixed to the inner layer at the second top edge.

14. The support garment of claim 9, wherein the first pocket panel is affixed to the second pocket panel along a first side edge and a second side edge of the first pocket panel, wherein the first side edge and the second side edge extend between the first top edge and the second top edge, respectively, and wherein the first side edge and the second side edge at least partially define the pocket space.

15. The support garment of claim 14, wherein the first pocket panel and the second pocket panel are affixed only to each other along their respective first side edges and the second side edges.

16. The support garment of claim 9, wherein a knitted tunnel at least partially formed by the first layer of material and located adjacent the first top edge and the second top edge, wherein the tunnel is configured to receive a tensioning element.

17. The support garment of claim 16, wherein an aperture is formed through a pocket strip that at least partially forms the tunnel.

18. The support garment of claim 17, wherein the tensioning element comprises an elastic drawcord and a cord lock, and wherein the cord lock is configured to pass through the aperture such that it can be located on a first side of the tunnel or a second side of the tunnel.

19. An upper-torso support garment comprising:

a front portion configured to cover a chest region of a wearer;

a back portion that is coupled via shoulder straps to the front portion and that comprises:

an outer layer having a first top edge;

an inner layer that is affixed to the outer layer, that is spaced apart from the outer layer by an interstitial space, and that comprises a second top edge; and a pocket structure that is positioned inside the interstitial space and that comprises at least one pocket panel affixed to at least one of the first top edge and the second top edge, wherein the at least one pocket panel at least partially encloses a pocket space and the pocket space is accessible between the first top edge and the second top edge, wherein the support garment includes a first state and a second state, wherein the first state comprises the support garment in a wearable configuration with the at least one pocket panel positioned in the interstitial space, and wherein the second state comprises a stowage configuration in which the pocket space is inverted and comprises an inverted pocket space and the at least one pocket panel is positioned external to the inverted pocket space.

* * * * *